US006484512B1

(12) United States Patent
Anderson et al.

(10) Patent No.: US 6,484,512 B1
(45) Date of Patent: Nov. 26, 2002

(54) THERMOELECTRIC TEMPERATURE CONTROLLED DRAWER ASSEMBLY

(75) Inventors: Ronald K. Anderson, Galesburg, IL (US); Sheldon W. Mandel, East Galesburg, IL (US); Robert C. Zimmerman, Galesburg, IL (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/876,100

(22) Filed: Jun. 8, 2001

(51) Int. Cl.[7] ..... F25B 21/02
(52) U.S. Cl. ..... 62/3.2; 62/3.6; 62/382
(58) Field of Search ..... 62/3.2, 3.6, 261, 62/382

(56) References Cited

U.S. PATENT DOCUMENTS

| | | | | |
|---|---|---|---|---|
| 2,837,899 A | | 6/1958 | Lindenblad | |
| 2,973,627 A | | 3/1961 | Lackey et al. | |
| 3,111,166 A | | 11/1963 | Munz et al. | |
| 3,733,836 A | | 5/1973 | Corini | |
| 4,364,234 A | | 12/1982 | Reed | |
| 4,463,569 A | | 8/1984 | McLarty | |
| 4,639,883 A | | 1/1987 | Michaelis | |
| 4,751,826 A | * | 6/1988 | Kawahara et al. | 62/382 |
| 4,838,911 A | * | 6/1989 | Robertson et al. | 62/3.3 |
| 4,891,949 A | | 1/1990 | Caldarola | |
| 5,277,039 A | | 1/1994 | Haasis | |
| 5,301,508 A | | 4/1994 | Kahl et al. | |
| 5,319,937 A | | 6/1994 | Fritsch et al. | |
| 5,381,672 A | | 1/1995 | Haasis | |
| 5,501,076 A | | 3/1996 | Sharp, III et al. | |
| 5,551,241 A | * | 9/1996 | Boeckel et al. | 494/14 |
| 5,572,873 A | * | 11/1996 | Lavigne et al. | 62/126 |
| 5,605,047 A | | 2/1997 | Park et al. | |
| 5,657,639 A | | 8/1997 | Lidbeck | |
| 5,661,978 A | | 9/1997 | Holmes et al. | |
| 6,089,237 A | * | 7/2000 | Podolak et al. | 131/300 |
| 6,122,918 A | * | 9/2000 | Johnson, Jr. | 62/3.6 |
| 6,202,432 B1 | * | 3/2001 | Haasis | 62/258 |
| 6,253,568 B1 | * | 7/2001 | Peffley | 312/199 |

FOREIGN PATENT DOCUMENTS

| | | |
|---|---|---|
| SU | 392300 | 7/1973 |

* cited by examiner

*Primary Examiner*—William E. Tapolcai
*Assistant Examiner*—Mohammad M. Ali
(74) *Attorney, Agent, or Firm*—Diederiks & Whitelaw, PLC

(57) ABSTRACT

A temperature controlled drawer assembly incorporates a thermoelectric device and a control system to selectively heat or cool the contents of a drawer which is selectively movable into and out of a cabinet designed to be part of an end table, such as a nightstand, or other cabinet remote from a household kitchen. In a cooling mode of operation, a fan, disposed in the cabinet, draws air from inside the drawer and blows the air over a cold side of a heat sink to cool the air. The treated air is blown through plenums, back into the drawer. At the same time, heat is drawn away from the cold side and directed out of the cabinet. The current through the heat sink may be reversed to flip the cold and hot sides of the heat sink to enable the contents of the drawer to be heated.

20 Claims, 4 Drawing Sheets

THERMOELECTRIC TEMPERATURE CONTROLLED DRAWER ASSEMBLY

BACKGROUND OF THE INVENTION

1. Field of the Invention

The present invention relates to a thermoelectric temperature controlled device including a drawer moveable within a cabinet designed to resemble a standard household end table, such as a night stand.

2. Discussion of the Prior Art

Thermoelectric devices which can selectively maintain their contents at an elevated or reduced temperature are known in the art. Such a device traditionally contains a power supply which provides energy necessary to move electrons through energy states across a bimetallic heat sink. As the electrons move from a lower energy state to a higher energy state, a cold junction is produced. Heat absorbed at the cold side is pumped to a hot side in proportion to the current supplied. By reversing the direction of the current, and therefore the heat flow, it is possible to change from a cooling device to a heating device.

People normally keep their beverages and other food items in a refrigerator located in a kitchen because of the necessity, or simply the desire, to maintain the particular items at a reduced temperature. With such a typical arrangement, when a cooled beverage is desired, a person must travel through the house to the refrigerator in the kitchen. Under certain circumstances, it may not be convenient, or even possible, to obtain a beverage or the like from a kitchen refrigerator. It has also been known to place a mini-refrigerator in area of a household remote from a kitchen. However, such mini-refrigerator units are typically not aesthetically appealing, but rather stand out wherever they are placed.

Portable coolers could be used to store such items in potentially convenient locations, but this creates other problems. First, these passive coolers are typically only insulated boxes without any refrigeration systems and only function to maintain the difference between the internal and external temperatures. Therefore, in order to keep the contents at a reduced temperature, an additional cooling device must be used. The items could be placed in a refrigerator or freezer for a period before being placed in the cooler, or ice packs could be placed in the cooler to prolong the cooled state of the food items. Of course, non-refrigerated coolers only maintain the temperature of its contents. Because the cooler does not have any cooling device of its own, once the ice melts, or the items lose their initial cooled state, the entire cooler will cease to cool the items.

There have been developed systems for cooling using thermoelectric devices. These systems generally use a heat sink to dissipate heat from the device. In a typical heat sink arrangement, a heat generating device is provided with a number of electrically conductive fingers or fins which conduct excess heat away from the heat generating device. The excess heat is dissipated through the fingers. The amount of heat dissipated can be increased by forming the fingers with greater surface areas and/or creating an air flow across the fingers. Generally, in thermoelectric cooling devices, a fan draws air from inside a cooling chamber and blows the air across the cold side of a heat sink. Electric current flowing through the thermoelectric device causes heat to flow from the cold side to the hot side. As such, heat is extracted from the air inside the cooling chamber and drawn across the heat sink to the hot side, where the heat is dissipated.

Accordingly, small devices have been developed which actively cool their contents without bulky traditional refrigeration systems. The system described in U.S. Pat. No. 5,301,508 to Kahl et al. represents a portable container incorporating a cooling device. Essentially, the system represents a traditional passive cooler with a small removable refrigeration apparatus installed therein without any substantial air circulation apparatus. Although this system will actually cool the contents of the cooler, it is not very efficient. First, the location of the thermoelectric cooling element is on a wall adjacent to the opening. Therefore, when the cooler is opened, the fan inside the thermoelectric cooling element is drawing in ambient air. In addition, the thermoelectric unit does not efficiently distribute the cooled air throughout the chamber.

U.S. Pat. No. 3,733,836 to Corini discloses a cooling unit including an inner shell with a plurality of holes inside an associated cooling chamber. By positioning a thermoelectric device and fan between the inner shell and an outer shell, the fan distributes cooled air through the gap formed between the two shells. The cooled air then enters the cooling chamber through the holes. Although such a configuration works well for a device such as an ice cream cart, inserting a drawer into the cooling chamber would prevent adequate cooling of the chamber. Additionally, because air cannot flow across the hot side heat sink, the potential efficiency of the thermoelectric device is reduced.

Based on the above, there exists a need for an efficient thermoelectric device particularly adapted for conveniently storing and cooling food items. In addition, there exists a need for a compact thermoelectric cooling device which can be used in various environments, particularly in connection with conveniently storing food items in areas outside the kitchen.

SUMMARY OF THE INVENTION

The present invention is particularly directed to a cooling unit using a thermoelectric device with a fan to circulate cooled air throughout a cooling chamber. More specifically, a first fan is provided to draw air from the cooling chamber and blow the air across a cold side heat sink. The electric current supplied to the thermoelectric device causes the cold side heat sink to draw heat from the air and pass the absorbed heat to the hot side heat sink where it can be dissipated. The entire apparatus is preferably designed to resemble an end table, such as a nightstand, found in a typical household.

In a preferred form of the invention, a drawer is installed inside the thermoelectric cooling device. The fan blows cooled air from between an inner liner and an outer liner, and the drawer is designed to allow for the circulation of air through the drawer. In accordance with the invention, the same fan also draws air from inside the drawer, causes the air to flow over the cold side heat sink and then recycles the air back into the drawer. Specifically, the drawer is designed with various ports and openings to accommodate the desired circulation. In accordance with the most preferred form of the invention, the drawer is essentially constituted by a frame with many holes, rather than a traditional drawer having solid side walls.

The thermoelectric device is also provided with a second fan to increase system efficiency. As the first fan draws the air from inside the cooling chamber and blows the air across the cold side heat sink prior to returning the cooled air to the cooling chamber, the thermoelectric device causes absorbed heat to travel to a hot side heat sink. The second fan is located near the hot side heat sink such that the excess heat can be more quickly dissipated. With both the cold side heat sink fan and the hot side heat sink fan running, the temperature regulating efficiency of the thermoelectric device can be greatly increased.

Because the heat flow of a thermoelectric device depends upon the direction of current flow, the thermoelectric cooling drawer of the invention can also be used to heat the contents of the drawer. To change the thermoelectric device from a cooling mode to a heating mode, a switch is provided to reverse the polarity of the power supply. This causes the heat flow direction to be reversed and heat to build up on the drawer side of the thermoelectric device.

Additional objects, features and advantages of the invention will become more readily apparent from the following detailed description of a preferred embodiment thereof, when taken in conjunction with the drawings wherein like reference numerals refer to corresponding parts in the several views.

DETAILED DESCRIPTION OF THE PREFERRED EMBODIMENT

Figure 1:
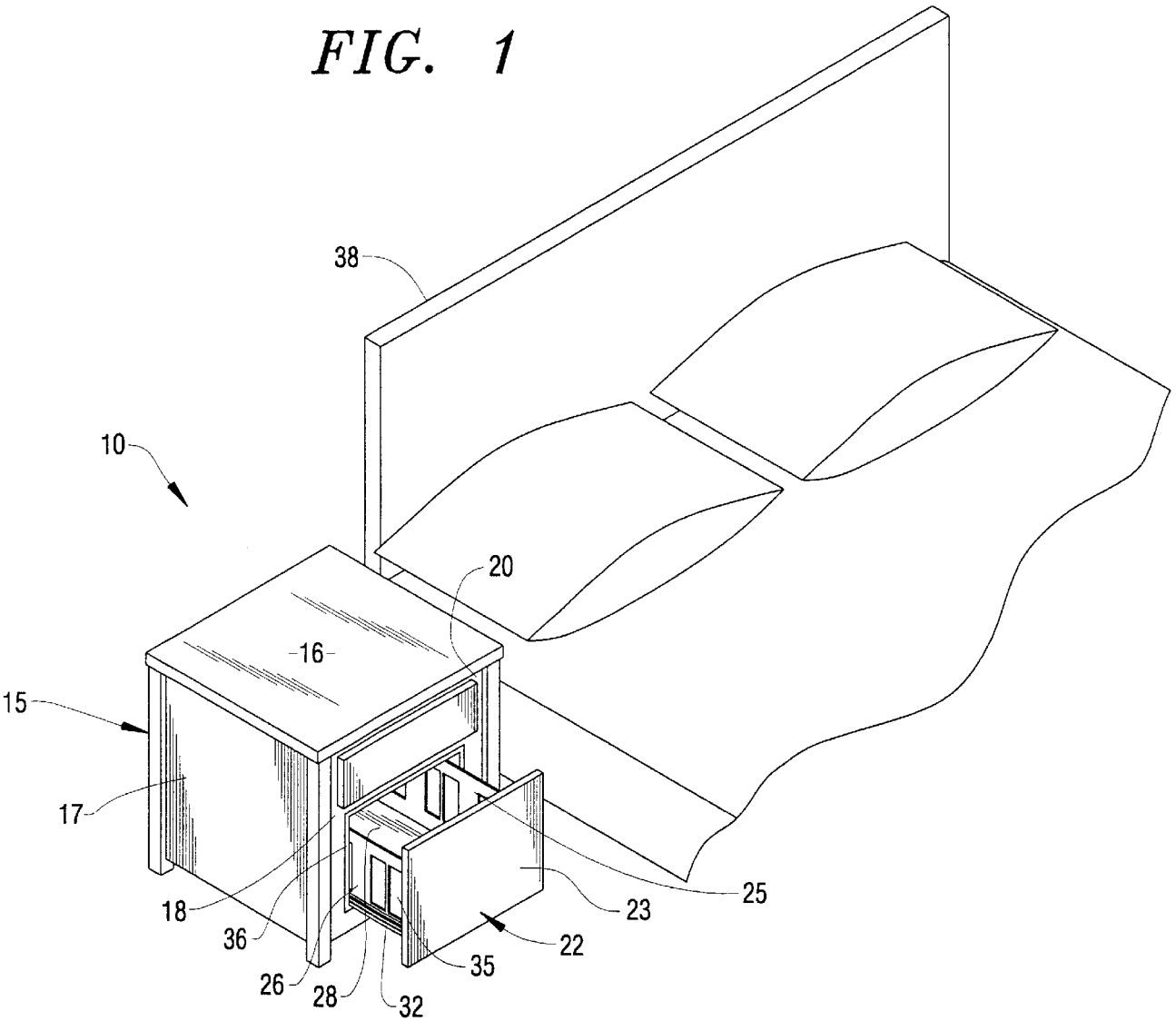
FIG. 1 is a perspective view of a preferred embodiment of the thermoelectric cooling device of the invention.
Figure 2:
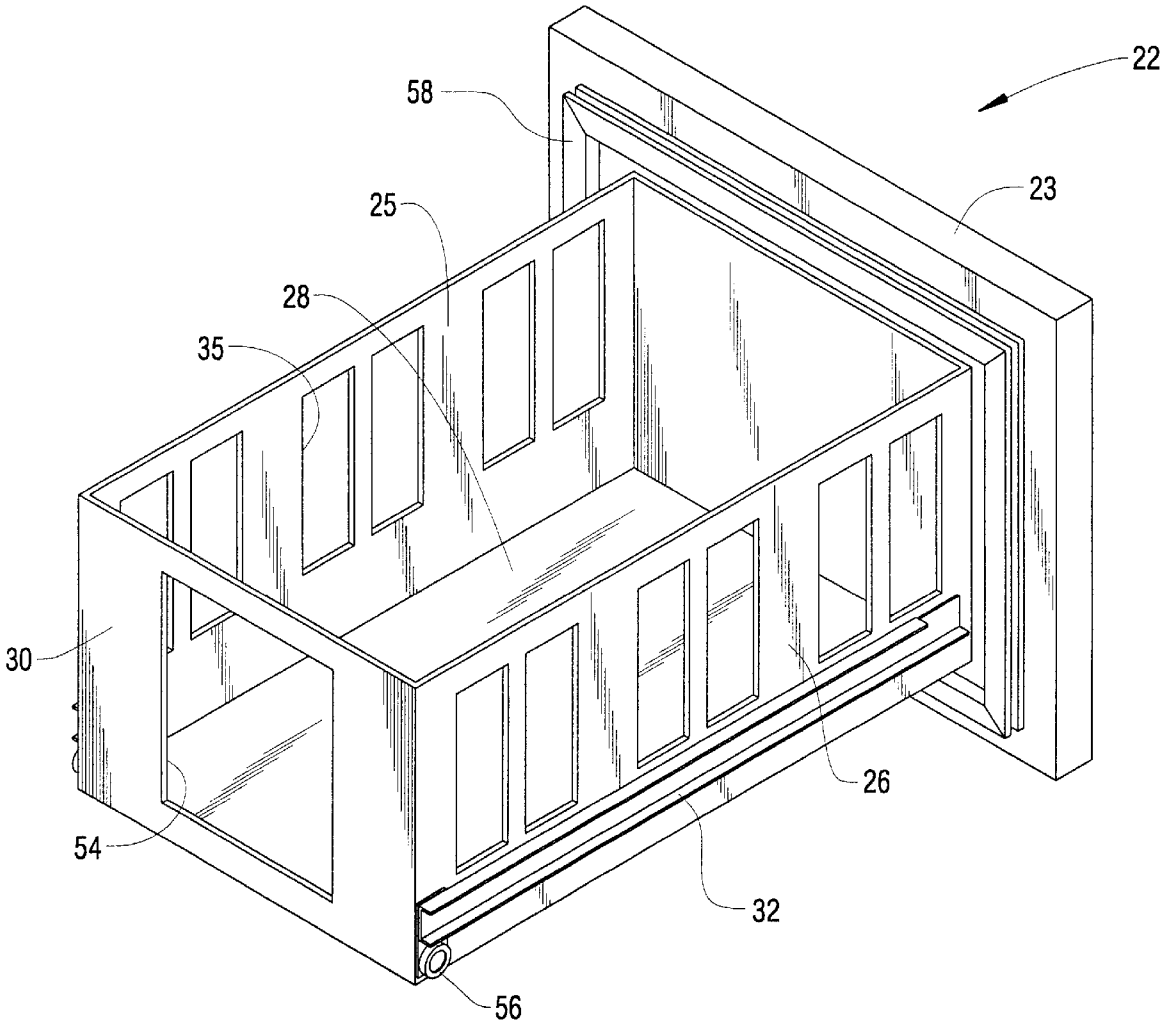
FIG. 2 is a perspective view of a drawer, incorporated in the thermoelectric cooling device of FIG. 1.

FIG. 1 depicts an embodiment of a thermoelectric cooling device 10 constructed in accordance with the present invention. In the preferred embodiment, a cabinet 15 is provided which essentially resembles a nightstand used in a typical bedroom, but could equally constitute another type of end table such as that found in a living room or a family room. Cabinet 15 includes at least a top 16, opposing side walls 17 and a front 18. Inside cabinet 15 is defined a drawer space 20 which opens at front 18 of cabinet 15. Disposed inside drawer space 20 is a drawer 22. The drawer 22 is shown to include a face 23, two upstanding, spaced apart sides 25 and 26, and a bottom 28 extending between sides 25 and 26. Opposite drawer face 23 is a substantially parallel back 30 as best shown in FIG. 2. Drawer 22 is preferably suspended on rails 32 which mate with corresponding rail structure inside drawer space 20 to allow for sliding movement of drawer 22 in and out of cabinet 15. Each of the sides 25 and 26 is provided with enlarged vent holes 35, with enlarged vent holes 35 being preferably rectangular in shape and spaced along the length of a respective side 25, 26 to allow for air flow. At the front 18 of cabinet 15, slightly spaced from and extending about drawer space 20, is an annular magnetic strip 36, arranged for sealing face 23 to front 18 when drawer 22 is closed, as will be discussed further below.

FIG. 2 shows the entire structure of drawer 22 which has been removed from cabinet 15. Drawer 22 basically constitutes a box, with the top removed and vent holes 35 provided. The main distinction between a standard cabinet drawer and drawer 22 of the invention is the structure of sides 25 and 26, as well as back 30. On each of sides 25 and 26, three pairs of vent holes 35 are preferably provided. Back 30 has an enlarged opening 54. When inserted into space 20, vent holes 35 and opening 54 allow for the circulation of air, as will be detailed below. Drawer wheels 56 are shown below rails 32 on each of sides 25 and 26. In general, the construction and operation of rails 32 and wheels 56 are widely known in the art and therefore will not be described in detail here.

FIG. 2 also shows a gasket 58 disposed on an inside of face 23. Because sides 25 and 26 are preferably elongated and parallel, drawer 22 is generally rectangular in shape. When drawer 22 is closed, gasket 58 abuts front 18 to effectively seal space 20 and prevent any influx of ambient air. In a preferred embodiment, gasket 58 has an internal metal member (not shown) which becomes seated against magnetic strip 36 upon closing of drawer 22 in order to provide a substantially air tight seal. Of course, other sealing arrangements could be used and the positioning of the gasket 58 and magnetic strip 36 could be reversed.

Figure 3:
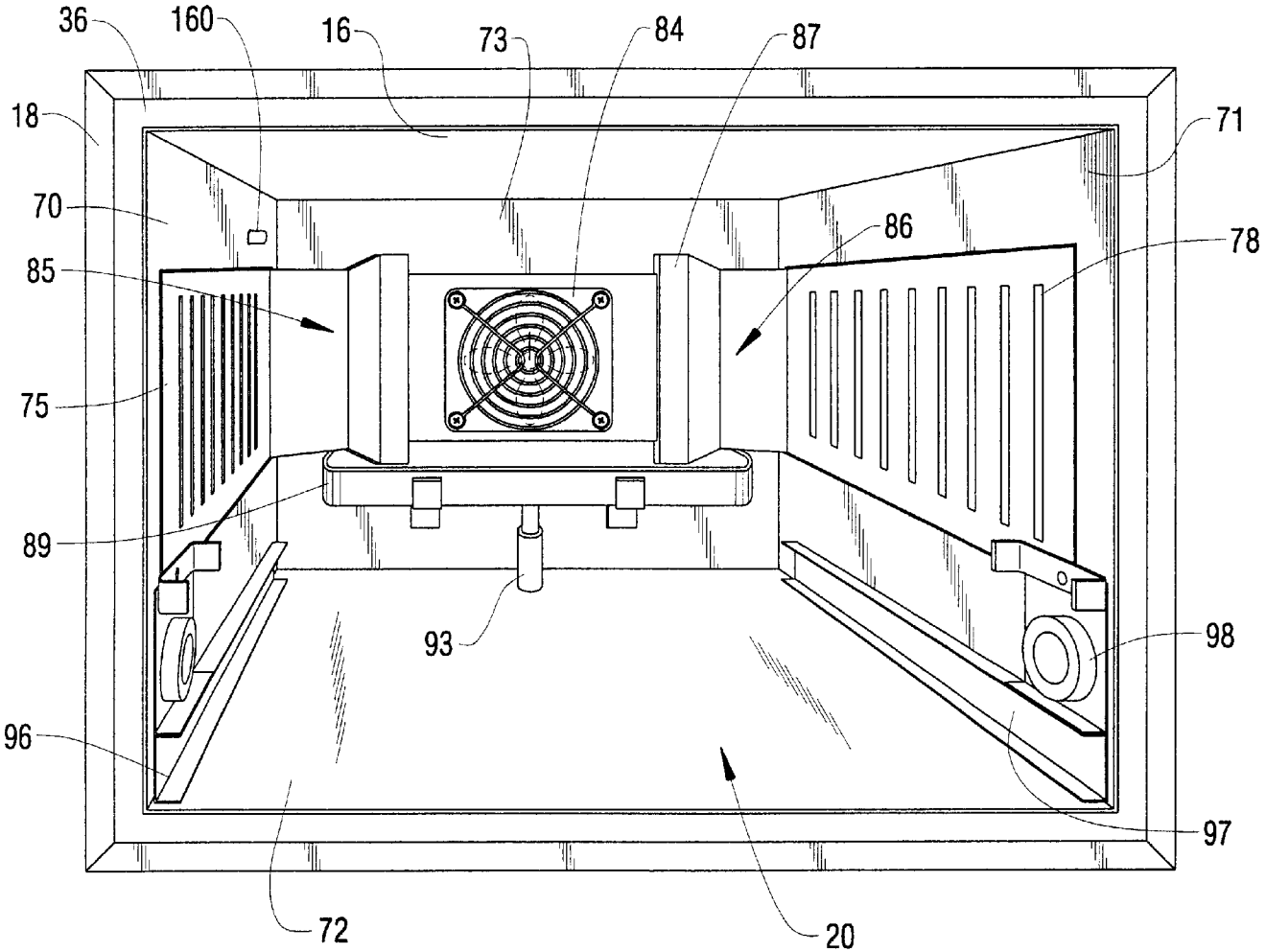
FIG. 3 is a front perspective view of the cooling chamber portion of the thermoelectric cooling device of the invention.

FIG. 3 shows the inside of drawer space 20, with drawer 22 removed. As shown, drawer space 20 is defined by two spaced apart side walls 70 and 71, a bottom wall 72 and a back wall 73, all of which are preferably, integrally formed by a single, thermoformed plastic liner. Located at each of side walls 70, 71 is a vent 75 which is preferably flush with the respective side wall 70, 71. A plurality of fore-to-aft spaced outlets in the form of slits 78 are present along vents 75.

Figure 4:
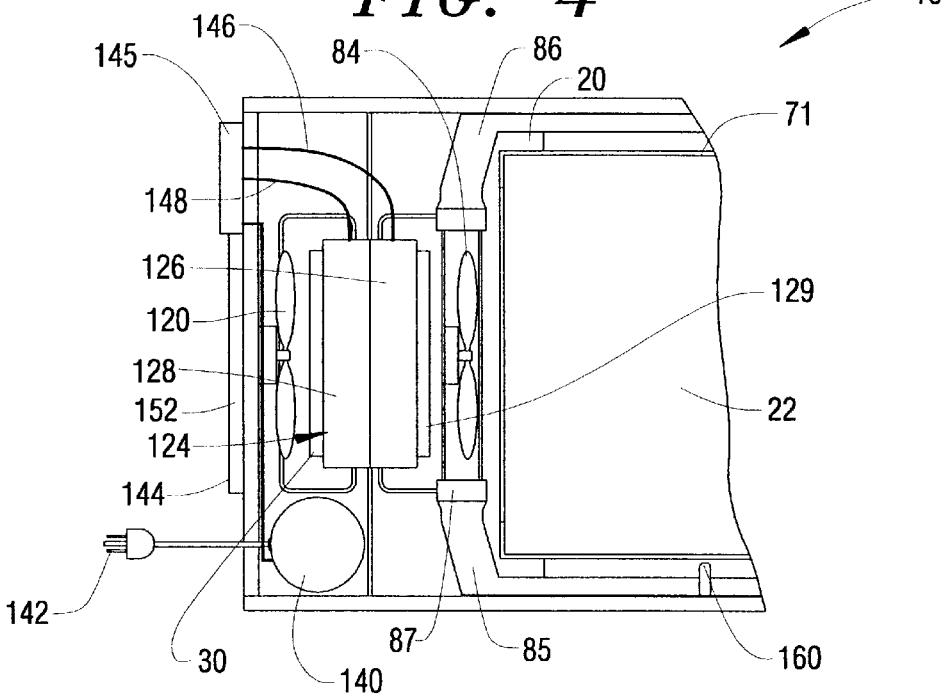
FIG. 4 is a cross-sectional top view of a rear portion of the thermoelectric cooling device of FIG. 1.

In the center of back wall 73 is a first or inside fan 84. Attached to the sides of, and in fluid communication with, inside fan 84 are two plenums 85 and 86. Where plenums 85 and 86 attach to inside fan 84, each plenum 85, 86 is defined by an enlarged section 87. Each plenum 85, 86 extends laterally from adjacent inside fan 84 completely to a respective side wall 70, 71 within drawer space 20, as best shown in FIGS. 3 and 4. Below inside fan 84 is a drip pan 89. In the embodiment shown, drip pan 89 has an associated drain 93 used to direct condensate through bottom wall 72. Although not shown, drain 93 preferably leads to a collecting pan located within cabinet 15 below drawer space 20. In the alternative, drain 93 need not be provided, wherein drip pan 89 will simply function to collect any condensate. As clearly shown in FIG. 3, drip pan 89 is readily accessible upon removing drawer 22.

Below slits 78 in vent 75 on each of side walls 70 and 71 are provided cabinet rails 96, 97 and a respective wheel or roller 98. Roller 98 and rails 96 and 97 are of a conventional design and function to support/guide drawer 22 into and out of drawer space 20 in combination with rails 32 and drawer wheels 56 in a manner known in the art as discussed above. In general, when drawer 22 is inserted into drawer space 20, rails 96, 97 and rollers 98 mate with drawer rails 32 and drawer wheels 56 to allow drawer 22 to slide in and out of drawer space 20.

Figure 5:
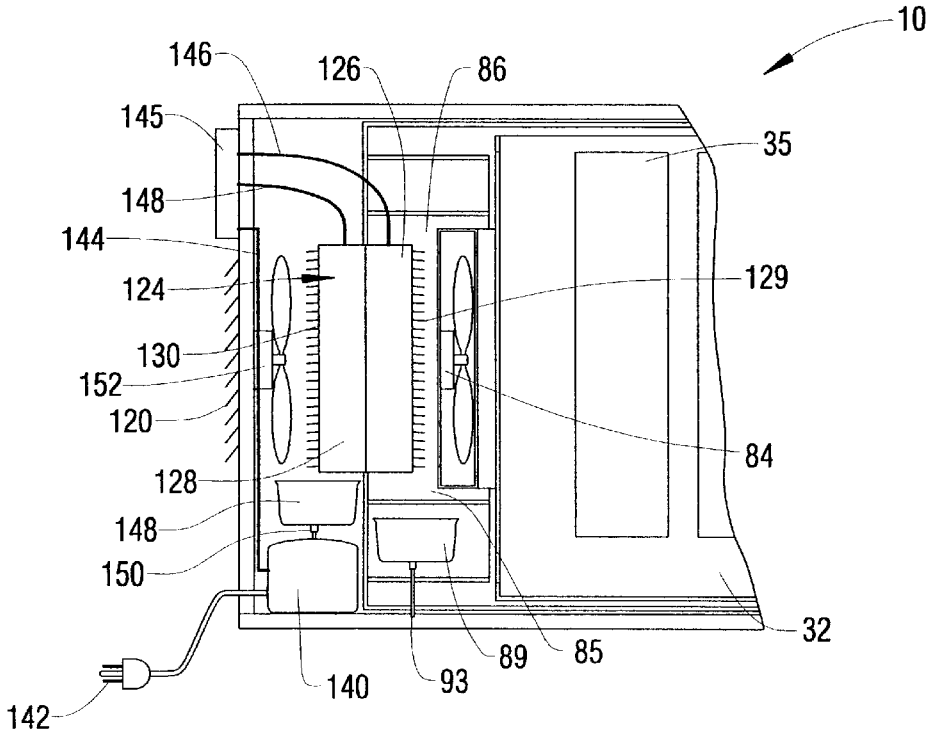
FIG. 5 is a cross-sectional side view of the rear portion of the thermoelectric cooling device of FIG. 1.

As best shown in FIGS. 4 and 5, immediately behind drawer 22 is inside fan 84. Plenums 85 and 86 can be seen extending laterally from adjacent fan 84. Behind inside fan 84 is an outside fan 120. Between inside fan 84 and outside fan 120 is a heat sink 124 which forms part of a thermoelectric temperature regulating device. Heat sink 124 is divided into a cold side 126 and a hot side 128. When heat sink 124 is in cooling mode as shown in these figures, cold side 126 is located near inside fan 84, and hot side 128 is located near outside fan 120. On at least the surface closest to fans 84 and 120, heat sink 124 is provided with a plurality of fingers or fins 129 and 130 to assist in heat dissipation and absorption.

Adjacent hot side 128 of heat sink 124 is a power supply 140 which delivers electricity to heat sink 124. Power supply 140 includes a standard three-prong plug 142 which is adapted to fit into a common household grounded socket. Via a switch wire 144, a control box 145, incorporating control circuitry and an adjustable control element or switch (not shown), is electrically connected to power supply 140 to direct power to heat sink 124. Control box 145 is connected to both cold side 126 and hot side 128 through a cold side wire 146 and a hot side wire 148, respectively. Switch box 145 is shown as being attached to a rear of cabinet 15, but may be in any location, as long as the electrical connections are maintained. As indicated above, control box 145 preferably houses a rotary or other switching arrangement that is used to selectively regulate the power transferred from supply 140 to heat sink 124. As mentioned above and shown in FIG. 5, drip pan 89 extends below cold side 126 and is preferably accessible upon removing drawer 22 from drawer space 20. In addition, a second drip pan 148 is located below hot side 128 to funnel any condensate into a second drain 150.

When thermoelectric cooling device 10, and hence control box 145, is in a COOL mode, a maximum temperature is selected through control box 145. When, via thermistor 160 which is linked to switch box 145 (see FIGS. 3 and 4), control box 145 detects an over temperature condition, both inside fan 84 and outside fan 120 are activated to blow air across fins 129 and 130 of heat sink 124. Inside fan 84 draws air from inside drawer 22, through opening 54, and blows the air across fins 129 of cool side 126. Because the current is flowing from cold side 126 to hot side 128 and the current pulls the heat with it, cold side 126 draws heat from the air into heat sink 124. The inclusion of fins 129 and 130 allows a more efficient transfer of heat at both sides of heat sink 124.

Once the air is cooled, i.e., the heat is absorbed into heat sink 124, the air is blown into plenums 85 and 86. Because plenums 85 and 86 are provided with slits 78 of vents 75 on side walls 70 and 71, the air is blown through plenums 85 and 86 and out slits 78. When drawer 22 is inserted into drawer space 20, vent holes 35 line up with slits 78 to allow the air to directly enter the interior of drawer 22. Most preferably, each vent hole 35 aligns with multiple slits 78 such that, as the air flowing out of slits 78 deaccelerates and expands in breadth, substantially the entire air flow will be directed into drawer 22. The air is then recirculated within drawer 22 and drawn to inside fan 84 through opening 54. The heat absorbed through fins 129 on cold side 126 is moved through heat sink 124 to hot side 128. Because hot side 128 also has its own fins 130, outside fan 120 assists in the dissipation of the absorbed heat by blowing air across fins 130 and out a plurality of louvers 152 provided at the back face of cabinet 15.

Thermoelectric cooling device 10 of the invention may also be used to heat the contents of drawer 22. Preferably, control box 145 can accessed to selectively determine the direction of the current flow through heat sink 124. Because of the thermoelectric properties of heat sink 124, when the current flows from cold side 126 to hot side 128, the current pulls the heat with it. Therefore, when control box 145 is placed in a COOL setting, the current is caused to flow to cold side 126 of heat sink 124. When a HOT setting is selected, the current flows in the opposite direction through heat sink 124, and hot side 128 and cold side 126 actually flip, i.e., the side adjacent inside fan 84 becomes the hot side and the side adjacent outside fan 120 becomes the cold side. With the current reversed, outside fan 120 draws in cool air through louvers 152 and blows the air across the fins on the cold side of heat sink 124. Heat sink 124 absorbs heat from the air and pulls it across to the hot side. Air, which has been drawn through opening 54 from inside drawer 22 is then blown across fins 130 on the hot side, where it absorbs the excess heat which was pulled from the outside air. Finally, the treated air is then blown through plenums 85 and 86 and back into drawer 22.

As indicated above, drip pans 89 and 148 are located to collect any condensate which may develop on fins 129 and 130 on either side of heat sink 124. When the temperature of fins 130 drops below 0° C., ice will form on them. When the temperature increases, either because device 10 has been shut off or due to a low power state, the ice will melt. The melting ice will be collected in drip pans 89 and/or 148. The invention requires two drip pans 93 and 148 because, depending upon the setting at control box 145 and the direction of current flow, ice and water may collect on either side of heat sink 124. At this point, it should be realized that drip pans 89 and 148 may share a common drain.

It should also be realized that the switch associated with control box 145 may take on a variety of forms. In its simplest form, the switch would be a three-position switch, which can be set to COOL, HEAT, or OFF positions, with the current through heat sink 124 being constant, but the direction being alterable. In a more complex scheme, the switch can be constituted by a temperature dial, with control box 145 including electronic logic controls through which a user would select a desired temperature. Using the thermistor 160, the controls would be able to determine the current temperature within drawer 22 and determine if device 10 should be placed in a COOL, HEAT or OFF mode. Therefore, control box 145 could automatically change the direction of current flow in response to the temperature reading from thermistor 160. Control box 145 could also adjust the amount of current flowing through heat sink 124 to vary the amount of heat transfer. Alternatively, control box 145 may include a timer which would allow a user to set the apparatus to automatically start-up at a desired time.

Although described with reference to a preferred embodiment, it should be readily understood that various changes and/or modifications could be made to the invention without departing from the spirit thereof. For instance, a control switch could be placed in various locations, including on drawer front 23 or on the side of cabinet 15. Additionally, rather than cabinet 15 be incorporated into a nightstand, thermoelectric cooling device 10 may take the form of other household or office cabinetry. In any event, it is preferable that device 10 remain inconspicuous, while enabling the cabinet to perform multiple functions, i.e., as a cooling device and a table. In addition, thermoelectric cooling device 10 of the invention may include two temperature adjusting drawers, i.e., a cooling drawer and a warming drawer. In such an arrangement, the hot side for the cooling drawer would preferably be positioned such that when air is blown across its fins, the warmed air would be circulated through the warming drawer. Otherwise, the structure and function of the cooling drawer would be the same as in the embodiment discussed above. Alternatively, the warming drawer may contain an electric heater. Preferably, the warming drawer would be defined by a separate liner arranged within the cabinet above the cooling drawer with sufficient insulation therebetween. In any event, the invention is only intended to be limited by the scope of the following claims.

We claim:

1. A temperature controlled drawer assembly comprising:

a cabinet having at least top, front and side walls, said cabinet defining an interior drawer space;

a drawer selectively slidable into and out of said drawer space, said drawer including a back wall, opposing side walls, a bottom wall and a front wall always exposed from the outside of the cabinet;

a thermoelectric temperature adjusting device mounted inside said cabinet;

a power source connected to said temperature adjusting device;

a fan, disposed adjacent to said temperature adjusting device, said fan being adapted to generate a flow of air across said temperature adjusting device; and a plenum defined inside said cabinet and extending from adjacent the fan to along a portion of the drawer, said plenum being formed with at least one outlet opening into the drawer space at a position remote from the fan, said plenum being adapted to receive the flow of air generated by the fan and to direct the flow of air into the drawer space through the at least one outlet.

2. The temperature controlled drawer assembly according to claim 1, further comprising: a control unit for regulating a temperature within the drawer space.

3. The temperature controlled drawer assembly according to claim 2, further comprising: a thermistor which extends into and is thermally exposed to said drawer space, said thermistor being electrically linked to the control unit for signaling a current temperature within the drawer space.

4. The temperature controlled drawer assembly according to claim 1, wherein said plenum extends along at least one of said side walls of said cabinet.

5. The temperature controlled drawer assembly according to claim 4, wherein said plenum includes a vent portion which defines the at least one outlet, said vent portion being flush with said at least one of said side walls of said cabinet.

6. The temperature controlled drawer assembly according to claim 1, further comprising: a drip pan positioned below said temperature adjusting device for collecting moisture.

7. The temperature controlled drawer assembly according to claim 6, wherein said drip pan is directly accessible from with said drawer space upon removal of said drawer.

8. The temperature controlled drawer assembly according to claim 1, wherein the temperature adjusting device constitutes a heat sink including a cold side and a hot side, said fan being disposed directly adjacent said cold side.

9. The temperature controlled drawer assembly according to claim 8, further comprising: an additional fan disposed directly adjacent the hot side of the heat sink for dissipating heat from the hot side.

10. The temperature controlled drawer assembly according to claim 1, wherein said drawer space is defined by a liner positioned within said cabinet.

11. The temperature controlled drawer assembly according to claim 10, wherein the liner is thermoformed of plastic.

12. The temperature controlled drawer assembly according to claim 1, further comprising: a magnetic seal between the front wall of the drawer and the cabinet.

13. The temperature controlled drawer assembly according to claim 12, wherein the magnetic seal includes a gasket disposed on said front wall of said drawer.

14. The temperature controlled drawer assembly according to claim 1, wherein the cabinet constitutes an end table.

15. The temperature controlled drawer assembly according to claim 14, wherein the end table constitutes a night stand.

16. A temperature controlled drawer assembly comprising:

a cabinet having at least top, front and side walls, said cabinet defining an interior drawer space;

a drawer selectively slidable into and out of said drawer space, said drawer including a back wall, opposing side walls, a bottom wall and a front wall;

a thermoelectric temperature adjusting device mounted inside said cabinet;

a power source connected to said temperature adjusting device;

a fan, disposed adjacent to said temperature adjusting device, said fan being adapted to generate a flow of air across said temperature adjusting device; and a plenum defined inside said cabinet and extending from adjacent the fan to along a portion of the drawer and along at least one of said side walls of said cabinet, said plenum being formed with at least one outlet opening into the drawer space at a position remote from the fan, said plenum being adapted to receive the flow of air generated by the fan and to direct the flow of air into the drawer space through the at least one outlet, wherein said plenum includes first and second plenum sections, with each plenum section extending along a respective one of the side walls of the cabinet, each of said plenum sections including a plurality of fore-to-aft spaced outlets arranged along the respective one of said side walls of said cabinet.

17. The temperature controlled drawer assembly according to claim 16, wherein each of the side walls of said drawer is formed with a multiple, spaced holes, said holes being arranged directly adjacent the outlets, at least when the drawer is wholly disposed within the drawer space.

18. The temperature controlled drawer assembly according to claim 17, wherein each of the holes in the drawer is enlarged relative to each of the outlets such that each said hole spans a plurality of the outlets of the plenum.

19. The temperature controlled drawer assembly according to claim 16, wherein each of the first and second plenum sections includes an enlarged section leading from the fan, with each of the first and second plenum sections tapering away from the enlarged section.

20. A temperature controlled drawer assembly comprising:

a cabinet having at least top, front and side walls, said cabinet defining an interior drawer space;

a drawer selectively slidable into and out of said drawer space, said drawer including a back wall, opposing side walls, a bottom wall and a front wall;

a thermoelectric temperature adjusting device mounted inside said cabinet;

a power source connected to said temperature adjusting device;

a fan, disposed adjacent to said temperature adjusting device, said fan being adapted to generate a flow of air across said temperature adjusting device;

an enlarged opening, formed in the back wall of the drawer, opposing said fan, said fan being adapted to draw the flow of air from the drawer through said enlarged opening; and a plenum defined inside said cabinet and extending from adjacent the fan to along a portion of the drawer, said plenum being formed with at least one outlet opening into the drawer space at a position remote from the fan, said plenum being adapted to receive the flow of air generated by the fan and to direct the flow of air into the drawer space through the at least one outlet.

* * * * *